US006547674B2

(12) United States Patent
Sladek

(10) Patent No.: US 6,547,674 B2
(45) Date of Patent: Apr. 15, 2003

(54) WUNDER WEDJE GOLF SYSTEM

(76) Inventor: Dennis Sladek Sladek, 733 E. Costilla, Suite D, Col. Springs, CO (US) 80903

( * ) Notice: Subject to any disclaimer, the term of this patent is extended or adjusted under 35 U.S.C. 154(b) by 0 days.

(21) Appl. No.: 09/846,564

(22) Filed: Apr. 30, 2001

(65) Prior Publication Data

US 2002/0032072 A1 Mar. 14, 2002

Related U.S. Application Data

(60) Provisional application No. 60/200,751, filed on May 1, 2000.

(51) Int. Cl.[7] ..... A63B 69/36
(52) U.S. Cl. ..... 473/270
(58) Field of Search ..... 473/270, 218, 473/219, 231, 238, 266

(56) References Cited

U.S. PATENT DOCUMENTS 3,275,320 A * 9/1966 Hydock ..... 473/270
4,279,420 A * 7/1981 Bay et al. ..... 473/270
5,141,232 A * 8/1992 Durso ..... 473/270
5,564,989 A * 10/1996 Larsen ..... 473/217
5,997,410 A * 12/1999 Nothdurft ..... 473/258

* cited by examiner

*Primary Examiner*—Paul T. Sewell
*Assistant Examiner*—M. Chambers

(57) ABSTRACT

The Wunder Wedje Golf System gives the average golfer for the first time, a simple and efficient tool to quickly and easily overcome some of the basic problems that hinder the golfer. It allows the golfer to utilize practice methods used by professionals in a simple and easy way to get the most out. It also allows the golfer to maintain consistent foot and ball position. It is a teaching and practice system that at a minimum would not hurt the golfer's game, but almost certainly would improve it.

1 Claim, 6 Drawing Sheets

WUNDER WEDJE GOLF SYSTEM

This application claims the benefit of Provisional Application No. 60/200,751 filed May 1, 2000.

CROSS REFERENCE TO RELATED APPLICATIONS:

Not Applicable

STATEMENT REGARDING FEDERALLY SPONSERED RESEARCH OR DEVELOPMENT

Not Applicable

REFERENCE TO A MICROFICHE APPENDIX

Not Applicable

BACKGROUND OF THE INVENTION

This invention pertains to the game of golf, especially for the amateur, but also for the professional since it is a practice and teaching aid.

To excel at the game, it is necessary that the golfer not only have the proper foot set-up, ball position, both between the feet and forward, but to be able to get into that position consistently. The professional does it routinely, the amateur occasionally. When the amateur's consistency increases, his score decreases.

Once the proper set-up is achieved, the next most important element in making the proper golf swing is being able to make the correct weight transfer from the golfer's back foot to the golfer's front foot. Again, the professional does it routinely, the amateur occasionally. It is this -one movement that most amateurs have a problem with, that if it can become routine greatly increases the consistency of good shots for the golfer. This equals lower scores.

What causes the problem for the amateur golfer is that when they start the takeaway of their swing, instead of keeping their upper body in a vertically straight position, they rock their body toward their back foot. This creates momentum to the rear so that when they start their downswing and need to move their weight to their forward foot, they have to fight this rear moving momentum. Few can. They never get to the final finishing position so that they never know how it feels.

BRIEF SUMMARY OF THE INVENTION

The Wunder Wedje is placed under the golfer's back foot with the flexible hinge side toward the front. It has three positions: 10 degrees, 20 degrees, and 30 degrees. It creates a foot support that allows the golfer to push off of something. This now enables the golfer to make the proper weight transfer from back to front. The more the golfer does it, the more his muscle memory increases until it becomes routine. This is evidenced by the fact that for years, teaching golf professionals have had students place a golf ball under the outside edge of their back foot near the ball of their foot. This created a wedge to give the golfer something to push off against.

DETAILED DESCRIPTION OF THE INVENTION

Figure 1:
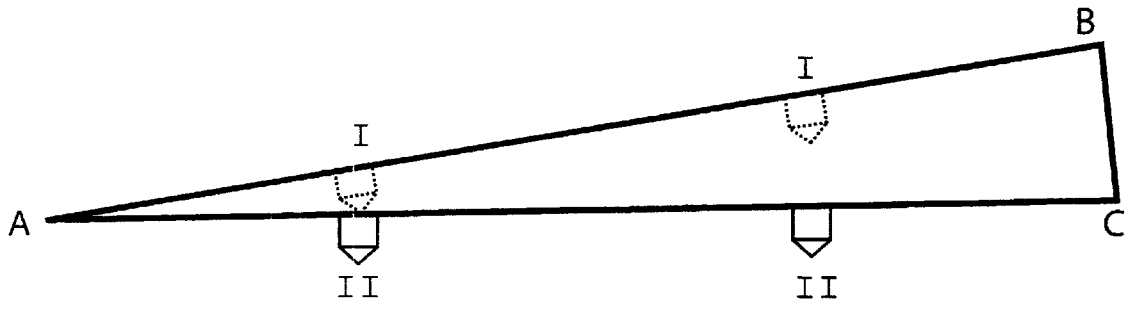
FIG. 1: This shows the end view of the three identical and interchangeable segments of the Wunder Wedje as if it were set up for a right handed golfer with it under his rear, or right foot. It is essentially an isosceles triangle with a 10 degree angle between the two sides 7" in length. A is the leading edge, B is the top edge, and C is the rear edge. The pegs marked "II" are to hold the segment in the ground or to snap into the top of another segment into the holes marked "I".
Figure 2:
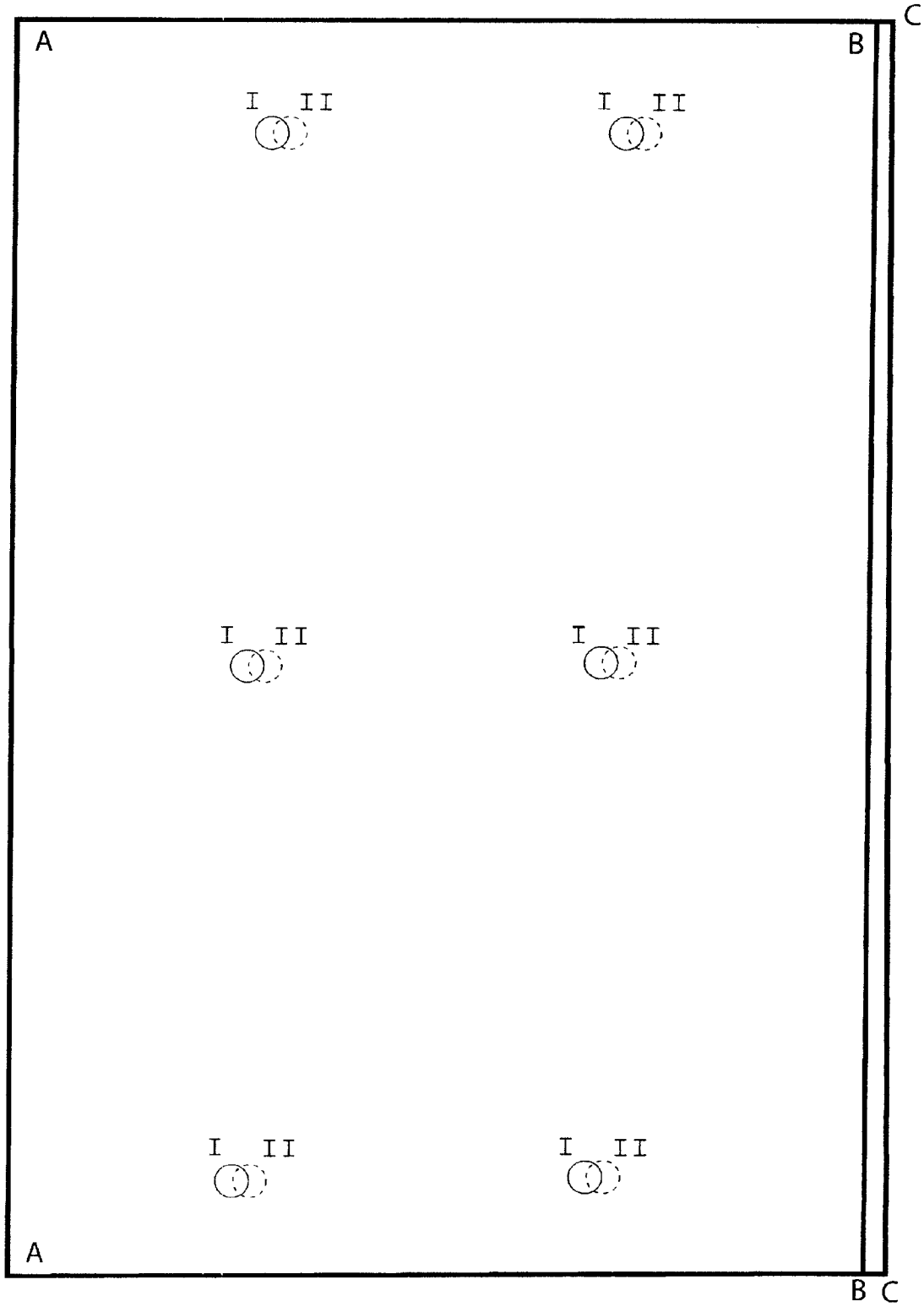
FIG. 2: This is the top view of the segment in FIG. 1 with a length of 12". It shows the leading edge "A", the top edge "B", and the bottom edge "C". The holes marked "I" are for the pegs marked "II" on other segments to snap into.
Figure 3:
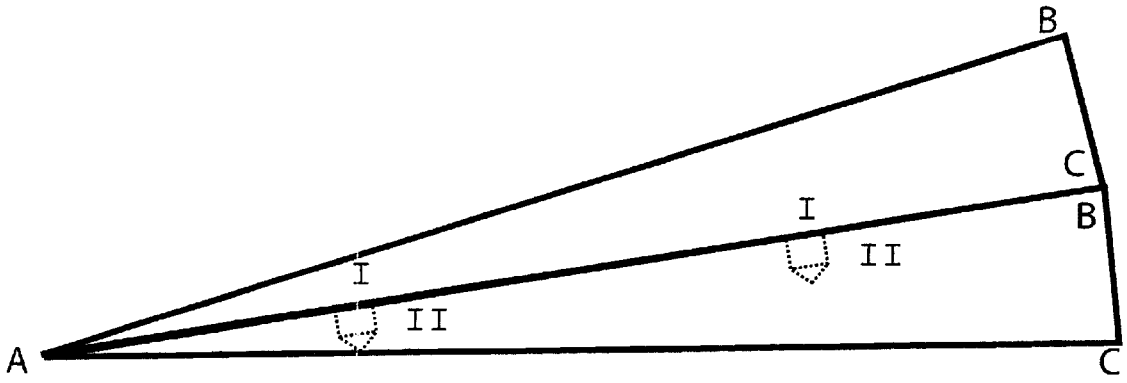
FIG. 3 This shows the segment in FIG. 1 and FIG. 2 snapped together creating a 20 degree segment. It shows the relevant parts of these segments.
Figure 4:
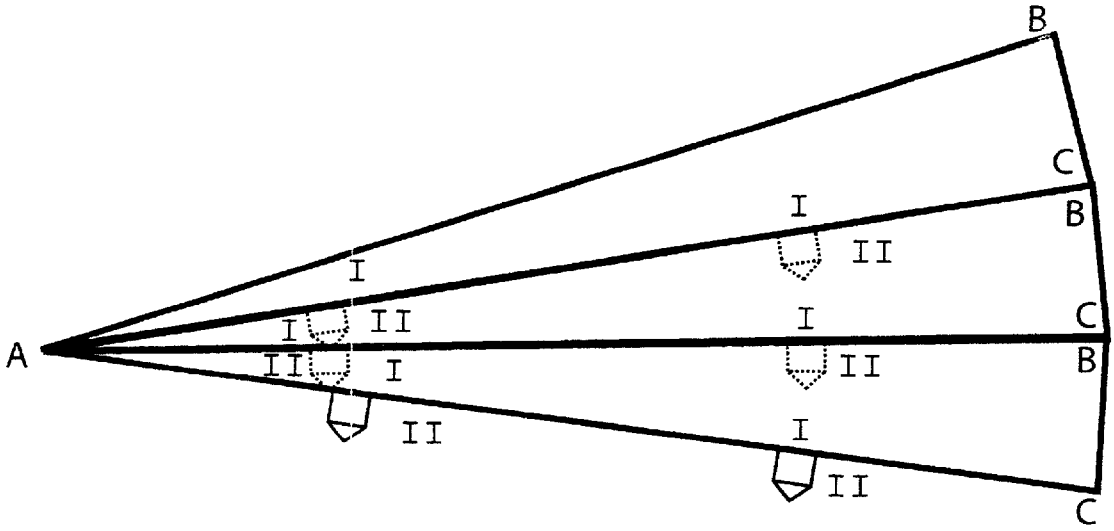
FIG. 4 This shows the three segments snapped together into creating a 30 degree segment Tt shows the relevant parts of those segments.
Figure 5:
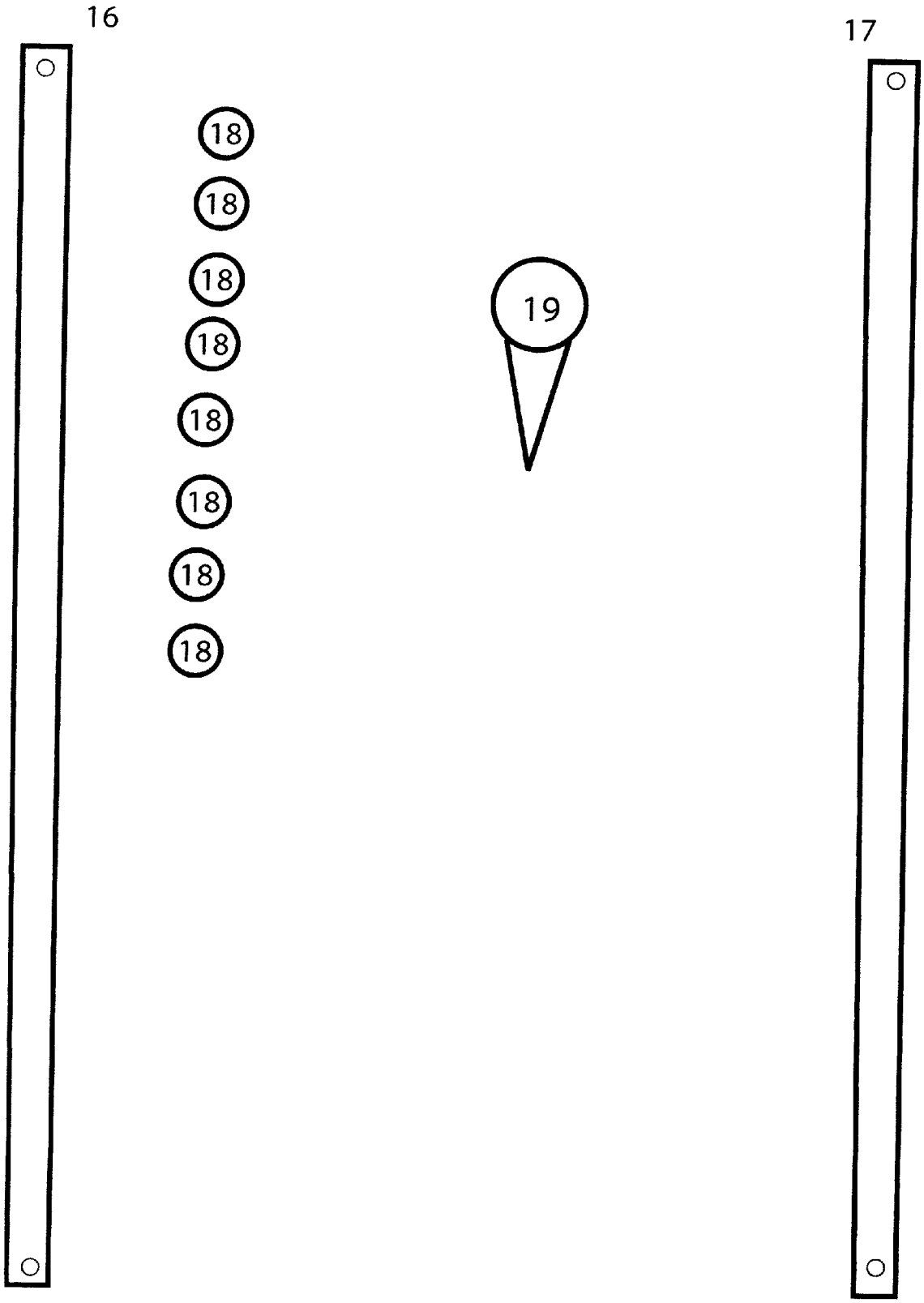
FIG. 5 This shows the additional parts of the invention. Items 16 and 17 are two Velcro strips 36" long by ¾" wide with prongs at each end to insert into the ground. The small circles marked 18 are the small ¾' diameter Velcro circles that are placed on the strip at the correct left foot and ball position for a particular club. The top four are a darker color for the foot position, with the bottom four a contrasting lighter color for the ball position. The item marked 19 is a 2" diameter circular disc or ball with a prong on the bottom to insert into the ground. This is placed forward of the ball about 4–6' directly in the line between the ball and the intended target.
Figure 6:
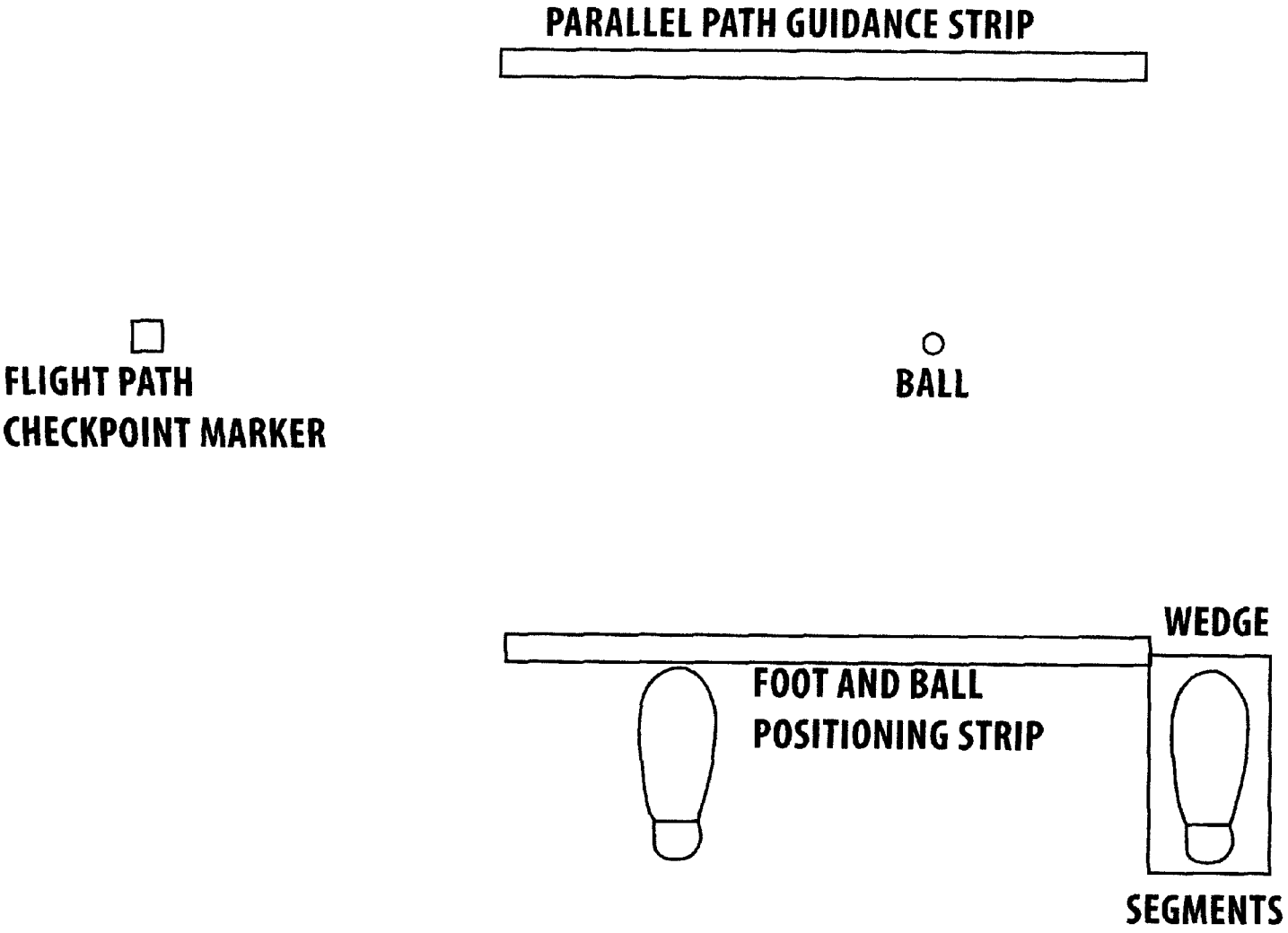
FIG. 6 This shows all of the components looking down at the ground from above the golfer. At the far right is the position where the segments of the Wunder Wedje are placed. It makes no difference for this drawing what combination they are in. The footprint in the drawing shows the position of the back foot on the segment(s). Perpendicular to the upper left corner of the segments is the foot and ball positioning strip. The footprint of the left foot shows where the foot should be placed. The strip above the ball which is parallel to the foot and ball positioning strip is the parallel path guidance strip which helps create a parallel path for the club head to follow. Forward of the ball, is the flight path checkpoint marker. It helps the golfer see early in the balls flight whether the ball is on the correct flight path and forces the golfer to keep his head down by checking the flight path early in the swing.

The Wunder Wedje and the support blocks are all made by injection molding out of a strong durable plastic. The flexible hinge is made of a flexible plastic. The guide strips and ball and foot position markers are Velcro. The mid-point guide is plastic with a prong on the bottom.

The problem with other methods such as placing a ball under the outside of the rear foot is that the ball would slip out making it inconvenient to constantly be bending over and replacing the ball. Others have tried to attach a wedge to the golfer's shoe but this can cause injury by stepping the wrong way and is uncomfortable to have something attached to a shoe. Additionally, a golfer can't walk out and play on a course that way. The Wunder Wedje sits there ready for the golfer to simply place his foot on top of it.

The teaching method is that the golfer starts with the 20 degree position and uses this until his consistency increases significantly. The key word is practice. It is what distinguishes the professional from the amateur. Once the consistency has increased to where the golfer is satisfied, he now goes down to the 10 degree position. Again, he stays at that position until his consistency has increased satisfactorily. When that point is reached, the golfer is now ready to stand on level ground. His muscle memory should be such that he no longer will need to use the Wunder Wedje. After that, the amateur can use it periodically to insure that muscles do not forget.

The 30 degree position is a specialized one. For short chip shots and other close in shots, it is necessary to keep all of the body weight on the front foot throughout the entire swing. Again, the professional does it routinely, the amateur occasionally. What causes the amateur the problem is that he uses the same body movement that he would use for all other shots as described above i.e. moving weight to back foot and then forward to the front foot. When using the 30 degree position, it is practically impossible to move the weight to the back foot because of the sharp angle. Therefore, all weight is on the front foot where it should be.

Now that the golfer has corrected that part of the swing, all that is left is to have the proper set-up i.e. foot and ball position. Starting at the upper left corner of the Wunder Wedje, and running perpendicular to the leading forward edge of the Wunder Wedje is a cloth Velcro strip approximately ¾" wide and 36" long. It has a prong at each end to secure into the ground. Once in place, the golfer does a simple body measurement to calculate the distance his forward foot should be from the leading edge of the Wunder Wedje for hitting his driver, his fairway woods and long irons, his middle iron, and his short irons. Four small Velcro circles all of the same color are then placed at each of those four positions on the Velcro strip attached to the ground. These indicate the position of the forward foot. Then, four more small Velcro circles of another contrasting color are placed on the Velcro strip to indicate the proper position of the ball for each of those four positions. Now all the golfer need do is place the golf ball forward of that ball position, perpendicular to the Velcro strip at the point where it is comfortable to their swing.

The second 36"×¾" Velcro strip is placed forward of the ball and parallel to the first Velcro strip. It creates a parallel path that helps the golfer maintain the same club head path through the downswing and into the follow through. Professionals for years have placed two golf clubs in those positions to create the same effect.

The round ball with the prong on the bottom is placed in the ground anywhere from 4–8' forward of the ball. It acts as a mid-flight check point between the ball and the desired target. Again, professionals would place a third golf club forward to create the same effect.

In short the Wunder Wedje now enables the amateur golfer to hone his skills by using the same methods used by professionals only in a simpler way and in a way that maximizes the results in far less practice time than a professional has available, since golf is their vocation. The whole system easily fits into one of the side pouches on a golfer's bag.

what is claim is:

1. A golf teaching system composed of the following items:

a) an injection molded plastic rear foot step composed of:
   1) three (3) angled interlocking 10 degree plastic segments, the bottom one creating a 10 degree segment; snapping the top segment to the bottom segment creating a 20 degree segment; and by snapping the top segment to the middle segment, and then snapping the middle segment to the bottom segment creating a 30 degree segment;

b) two (2) 36"×¾" lengths of black-colored Velcro-A cloth with a metal prong on each end to insert into the ground;

c) two (2) sets of 1-¼" round Velcro-B cloth with each set containing:
   i) one (1) red with the letters "D" in black on front;
   ii) one (1) red with the letters "LI" in black on the front;
   iii) one (1) red with the letters "MI" in black on the front;
   iv) one (1) red with the letters "SI" in black on the front;
   v) four (4) white;

d) one (1) mid-flight check point marker made out of injection molded plastic that looks like a golf ball on a tee, is colored blue, and is strong enough to be inserted into the ground;

e) one instructional video tape;

f) one instructional manual for the use of the system.

* * * * *

UNITED STATES PATENT AND TRADEMARK OFFICE

CERTIFICATE OF CORRECTION

PATENT NO. : 6,547,674 B2
DATED : April 15, 2003
INVENTOR(S) : Dennis Sladek

It is certified that error appears in the above-identified patent and that said Letters Patent is hereby corrected as shown below:

Title page,
Item [75], Inventor, delete "Dennis Sladek Sladek", and insert -- Dennis Sladek --.

Signed and Sealed this

Seventeenth Day of February, 2004

JON W. DUDAS
*Acting Director of the United States Patent and Trademark Office*